US008182247B2

(12) United States Patent
Gallwey et al.

(10) Patent No.: US 8,182,247 B2
(45) Date of Patent: May 22, 2012

(54) PUMP WITH STABILIZATION COMPONENT

(75) Inventors: Brady Gallwey, Houston, TX (US); Roy Tilford Jackson, Houston, TX (US); Duy D. Nguyen, Houston, TX (US); C. Tom Brannon, Houston, TX (US)

(73) Assignee: TXAM Pumps LLC, Houston, TX (US)

( * ) Notice: Subject to any disclaimer, the term of this patent is extended or adjusted under 35 U.S.C. 154(b) by 939 days.

(21) Appl. No.: 12/127,216

(22) Filed: May 27, 2008

(65) Prior Publication Data

US 2009/0297374 A1 Dec. 3, 2009

(51) Int. Cl.
*F04B 23/04* (2006.01)
*F04B 41/06* (2006.01)

(52) U.S. Cl. ..... 417/521; 92/140; 417/411

(58) Field of Classification Search ..... 417/437, 417/521, 411, 53; 92/140; 74/25, 49, 50, 74/38, 39, 40

See application file for complete search history.

(56) References Cited

U.S. PATENT DOCUMENTS

| | | | | | |
|---|---|---|---|---|---|
| 1,724,156 | A * | 8/1929 | Winton | 417/568 |
| 1,770,683 | A * | 7/1930 | Davis | 74/50 |
| 2,287,627 | A * | 6/1942 | Malsbary et al. | 92/94 |
| 2,325,672 | A * | 7/1943 | Groff | 417/454 |
| 2,737,896 | A * | 3/1956 | Neyer | 92/13.2 |
| 3,286,933 | A * | 11/1966 | Savage | 239/304 |
| 3,470,823 | A * | 10/1969 | Seeger | 417/536 |
| 3,635,597 | A * | 1/1972 | Marten | 417/568 |
| 4,260,342 | A * | 4/1981 | Leka et al. | 417/458 |
| 5,145,339 | A * | 9/1992 | Lehrke et al. | 417/521 |
| 5,769,321 | A * | 6/1998 | Cyphers | 239/154 |
| 5,938,416 | A * | 8/1999 | Saito et al. | 417/521 |
| 7,938,632 | B2 * | 5/2011 | Smith | 417/415 |
| 2006/0127231 | A1 * | 6/2006 | Sundheim | 417/234 |
| 2006/0275164 | A1 * | 12/2006 | Ganser | 417/521 |
| 2007/0048152 | A1 * | 3/2007 | Conally | 417/411 |
| 2008/0141855 | A1 * | 6/2008 | Fisher | 92/140 |

* cited by examiner

*Primary Examiner* — Devon C Kramer
*Assistant Examiner* — Joseph Herrmann
(74) *Attorney, Agent, or Firm* — Conley Rose, P.C.

(57) ABSTRACT

In at least some embodiments, a pump includes a turning member and a reciprocating member coupled to the turning member, the reciprocating member performing a pumping motion as the turning member turns. The pump also includes at least one stabilization component in contact with the reciprocating member to stabilize the pumping motion.

18 Claims, 4 Drawing Sheets

PUMP WITH STABILIZATION COMPONENT

BACKGROUND

A pump is a device that moves fluid from a first location to a second location. In some instances, a pump moves fluid from a lower pressure to a higher pressure. To perform these functions, pumps require energy and moving parts that provide a pumping motion. Over time, the moving parts can become stressed or worn out.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first component couples to a second component, that connection may be through a direct connection or through an indirect connection.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Embodiments of the disclosure are directed to pumps having moving parts that perform a pumping motion. In other words, the moving parts form a part of a pumping assembly. To help prevent the moving parts from becoming stressed or worn out, at least one stabilization component is employed to stabilize the pumping motion of the moving parts.

Figure 1:
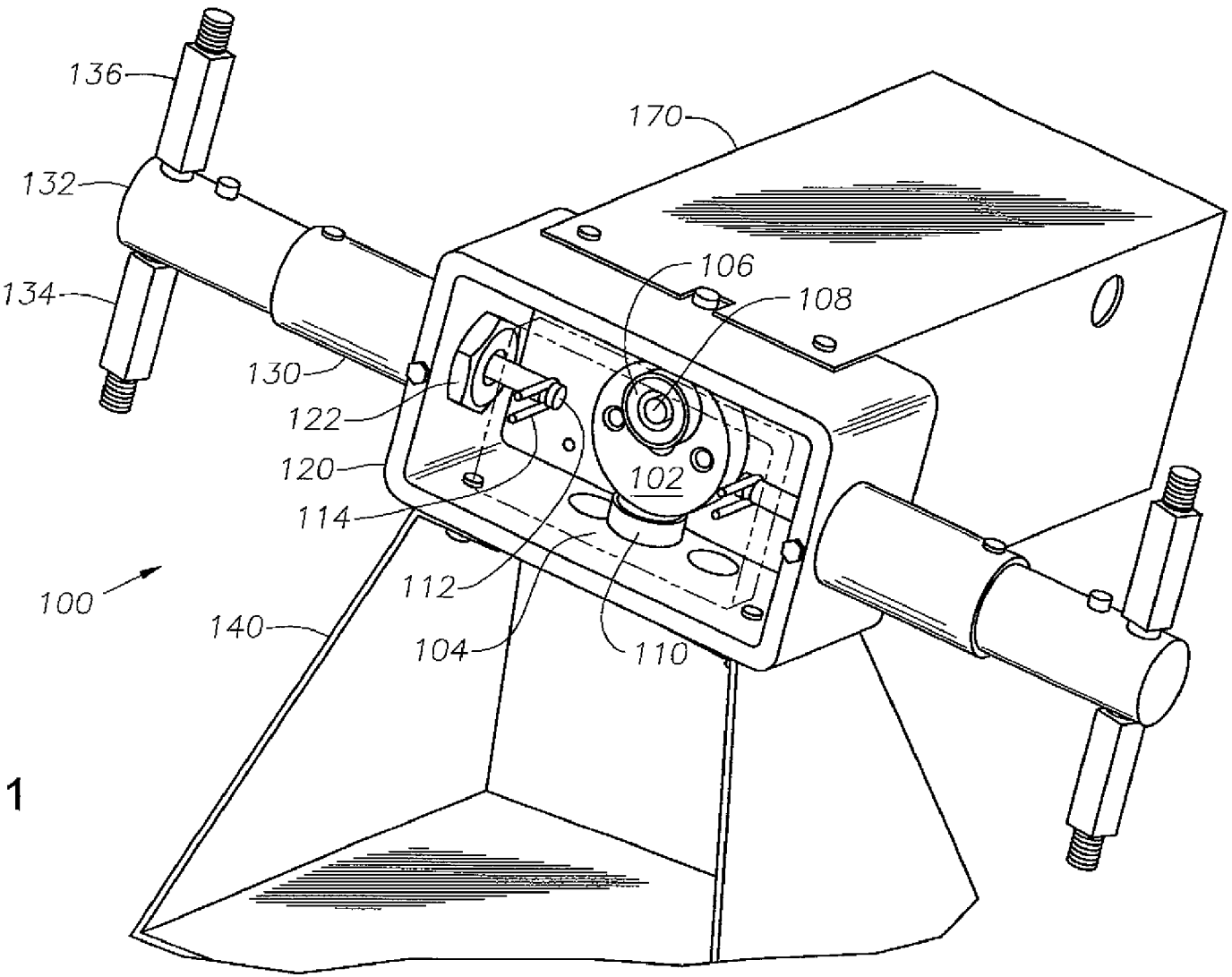
FIG. 1 shows a perspective view of a pump in accordance with embodiments of the disclosure.
Figure 2:
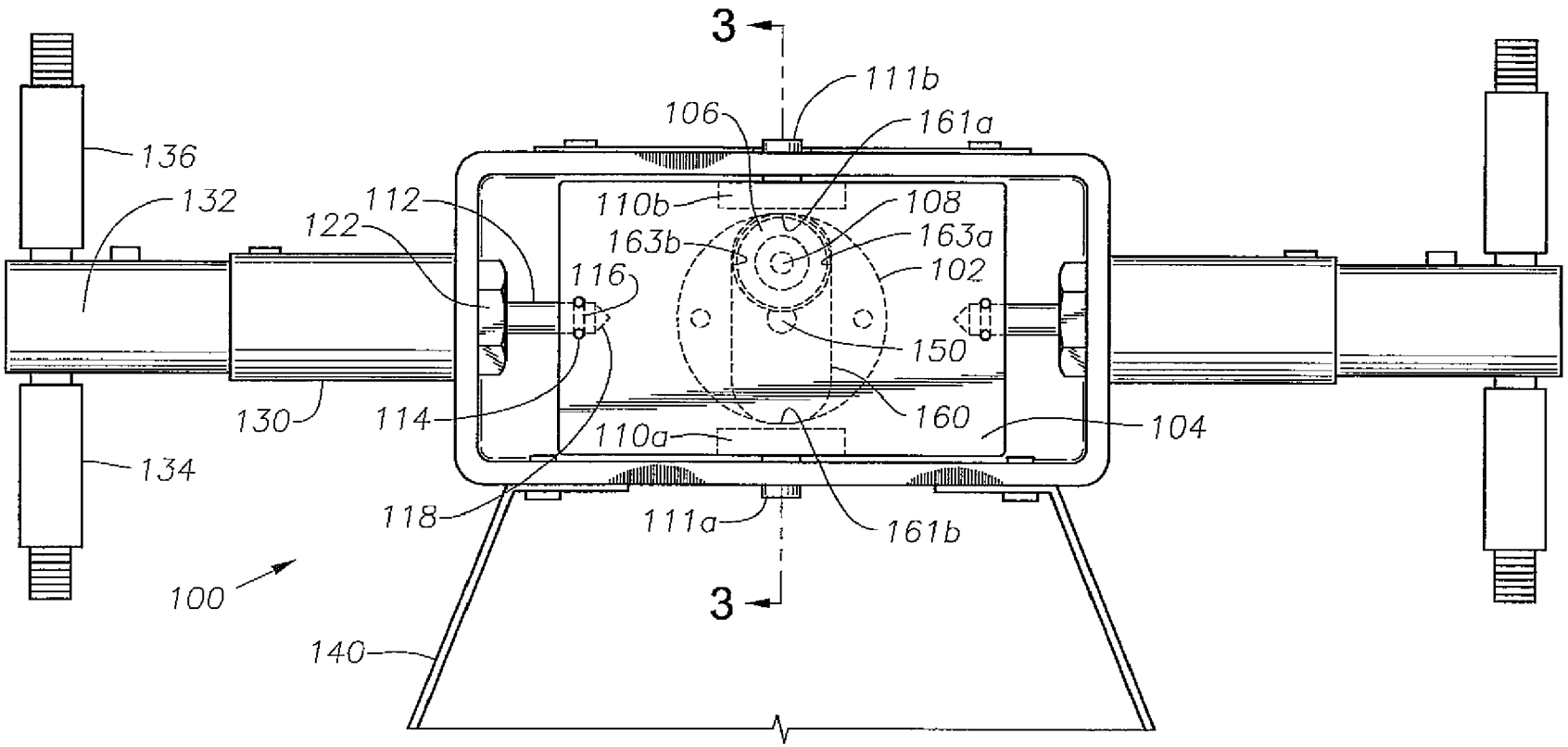
FIG. 2 shows a front view of the pump in accordance with embodiments of the disclosure.
Figure 3:
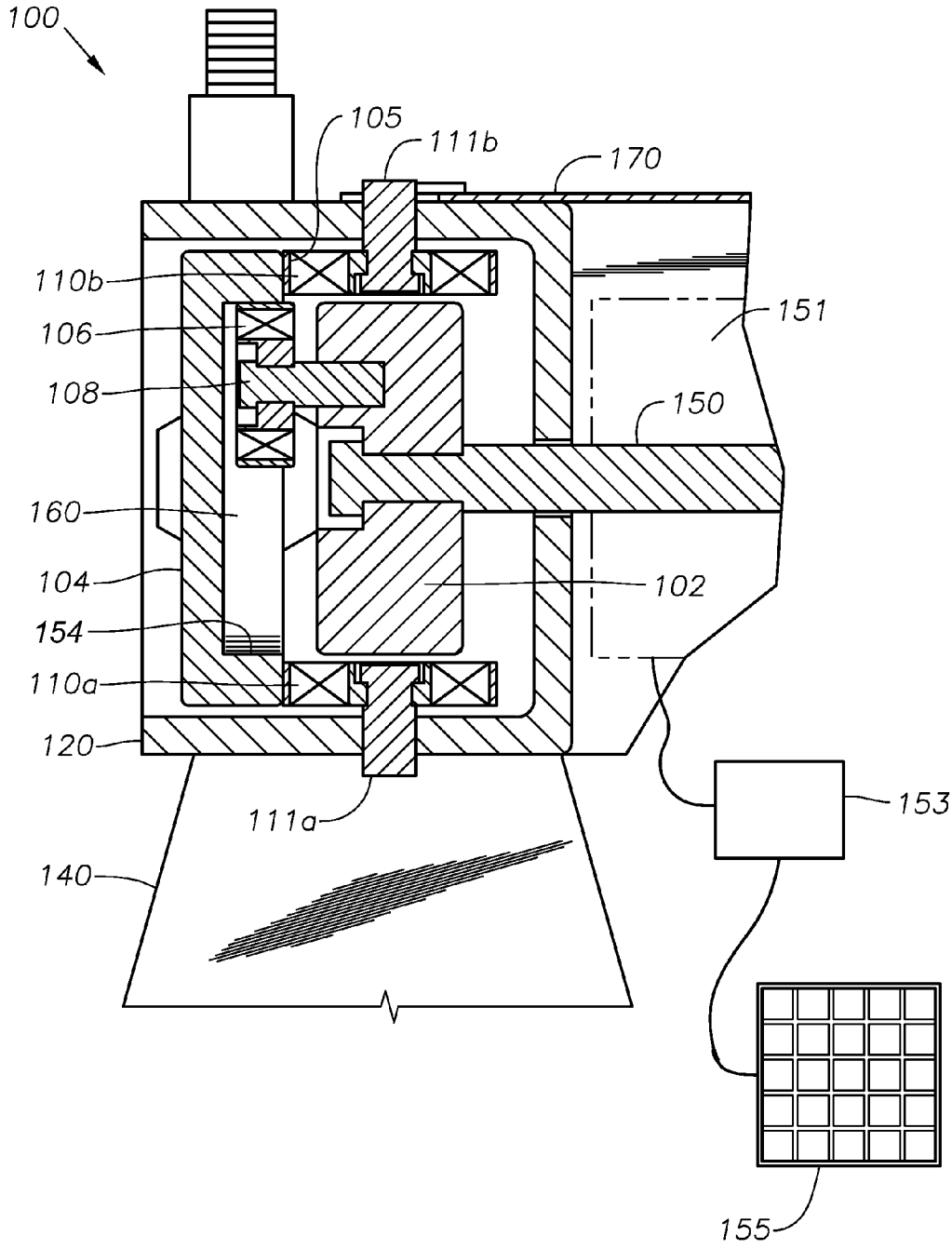
FIG. 3 shows a cross-sectional view of the pump in accordance with embodiments of the disclosure.

Referring to FIGS. 1-3, FIG. 1 shows a perspective view of a pump 100 in accordance with embodiments of the disclosure. In FIG. 1, the pump 100 comprises a pumping assembly having a turning member 102 coupled to a reciprocating member 104, best shown in FIG. 3. In FIG. 1, the turning member 102 corresponds to a metallic wheel. In alternative embodiments, the size, the shape, and the material of the turning member 102 may vary. In FIGS. 1 and 3, the reciprocating member 104 corresponds to a metallic block. In alternative embodiments, the size, the shape, and the material of the reciprocating member 104 may vary. In at least some embodiments, the turning member 102 couples to the reciprocating member 104 using an eccentric member 106 mounted off center on the turning member 102. The eccentric member 106 may be, for example, a bearing mounted in a parallel orientation with respect to the turning member 104. As the turning member 102 turns, the reciprocating member 104 contacts the eccentric member 106 and performs a pumping motion (back and forth) as described herein. To stabilize the pumping motion, at least one stabilization component 110 contacts the reciprocating member 104. For example, in at least some embodiments, the at least one stabilization component 110 corresponds to a bearing. As shown, the turning member 102, the reciprocating member 104 and the stabilization component 110 may be placed within a housing 120.

In FIG. 1, at least one plunger 112 couples to the reciprocating member 104 and follows the pumping motion. Although other coupling means may be used, the plunger 112 and the reciprocating member 104 are shown coupled using a pin 114 as shown in FIGS. 1 and 2. The plunger 112 extends though a plunger housing 130 to a pump head 132. Although other embodiments are possible, the plunger housing 130 is shown coupled to the housing 120 using a nut 122. In FIG. 1, a suction section 134 and a discharge section 136 extend from the pump head 132. Although not required, a similar assembly (i.e., a plunger, a plunger housing, a pump head, a suction section, and a discharge section) can be included on the other side of the reciprocating block 104 as shown in FIG. 1.

In at least some embodiments, the pump 100 further comprises a motor housing 170 for an electric motor 151 shown in FIG. 3 that turns the turning member 102. A motor shaft 150 is configured to rotate in at least one direction to cause the pumping motion. In at least some embodiments, the electric motor 151 operates on 12 or 24 volts. Without limitation to other embodiments, the pump 100 may be a chemical injection pump having the features shown in Table 1.

TABLE 1

| | |
|---|---|
| Maximum Pressure | 4000 psi |
| Plunger sizes | ¼", ⅜", ½" |
| Output gallons/day | Up to 200 |

In at least some embodiments, the electrical motor 151 employs a rechargeable battery 153 as the power supply. In such case, the rechargeable battery 153 may be recharged using available solar panels 155 (e.g., 50/60/85/110 watt panels). In at least some embodiments, the power consumption of the pump 100 is managed by automatically adjusting a pump cycle level in response to a power supply voltage level. If the power supply voltage level drops below predetermined thresholds, the pump cycle level is automatically lowered. Similarly, if the power supply voltage level rises above the predetermined thresholds, the pump cycle level is automatically increased. In at least some embodiments, the pump indicates a current pump cycle level and/or power supply voltage level to a user. Further, the pump may enable a user to dynamically select a default pump cycle level. For more information regarding relevant control systems for a pump, reference may be had to co-pending application Ser. No. 12,127,230, entitled "Electrical System For A Pump", filed May 27, 2008. The above application is hereby incorporated herein by reference in its entirety.

FIG. 2 shows a front view of the pump 100 in accordance with embodiments of the disclosure. FIG. 2 shows many of the features described for FIG. 1. FIG. 2 also shows a motor shaft 150 that couples the turning member 102 to electric motor 151 (e.g., in the motor housing 170). In addition, FIG. 3 shows that the eccentric bearing 106 fits within a recess 160 of the reciprocating member 104. The recess 160 may extend partially or completely through the reciprocating member 104. The recess forms a bearing wall 154 (shown in FIG. 3) having opposing bearing sides 161A, B and 163A, B (shown in FIG. 2). Opposing sides 163A, B are generally perpendicular to the direction of the pumping motion of the pump 100. In one embodiment, the recess 160 forms a generally rectangular shape having the opposing sides 161A, B and 163A, B. As the motor shaft 150 rotates the turning member 102 within recess 160, the eccentric bearing 106 contacts the sides 161 and 163 of the recess 160 in the reciprocating member 104. As the eccentric bearing 106 engages the sides 163A, B, the eccentric bearing 106 applies a force to bearing sides 163A, B causing the reciprocating member 104 to reciprocate.

In FIGS. 2 and 3, stabilization components 110A and 110B are located above and below the turning member 102 in a perpendicular orientation with respect to the turning member. More specifically, the stabilization components 110A and 110B may be located between the turning member 102 and the housing 120 to contact the inside periphery 105 of reciprocating member 104. In this manner, the stabilization components 110A and 110B may be held in place without complicated means. Further, pins 111A and 111B may be rotatably disposed on the stabilization components 110A and 110B respectively to hold the stabilization components 110A and 110B in place. As shown, the pins 111A and 111B may extend through the housing 120. Alternatively, the pins 111A and 111B extend into but not through the housing 120.

In FIG. 2, the plunger 112 includes a groove 116, which fits into a plunger reception gap 118 provided in the reciprocating member 104. To attach the plunger 112 to the reciprocating member 104, the pin 114 extends through the reciprocating member 104 and latches onto the groove 116 of the plunger 112 while the plunger 112 is in the plunger reception gap 118. To connect or disconnect the plunger 112 and the reciprocating member 104, the pin 114 can be inserted into and/or pulled out of the groove 116 in a direction approximately perpendicular to the pumping motion.

FIG. 3 shows a cross-sectional view of the pump 100 in accordance with embodiments of FIGS. 1 and 2. The motor shaft 150 is shown extending from the electric motor 151 in motor housing 170 to the turning member 102, such as a wheel. In FIG. 3, a clearance is shown between the stabilization components 110A and 110B and the housing 120. In various embodiments, this clearance may be larger or smaller. If the stabilization components 110A and 110B correspond to bearings, such clearances enable the bearings to turn without interference from the housing 120. Similar clearances are shown between the stabilization components 110A and 110B and the turning member 102. As shown in FIG. 3, the stabilization components 110A and 110B contact the reciprocating member 104 to ensure a smooth pumping motion.

Also shown in FIG. 3 is the eccentric bearing 106 mounted to the turning member 102 with a pin 108 although other connectors are possible. The eccentric bearing 106 fits into the recess 160 of the reciprocating member 104. As shown FIGS. 2 and 3, the curved (rolling edge) portion of the eccentric bearing 106 contacts the sides 161, 163 of recess 160 and causes the pumping motion of the reciprocating member 104 as the turning member 102 turns. Meanwhile, clearances are shown for each flat (non-rolling) edge of the eccentric bearing 106 (between each of the reciprocating member 104 and the turning member 102). In this manner, there is no interference of the rolling function of the eccentric bearing 106 along the recess 160 by unnecessary contact with either the turning member 102 or the reciprocating member 104. Clearances are also shown between the reciprocating member 104 and the housing 120 to prevent unnecessary contact between the housing 120 and the reciprocating member 104 during the pumping motion.

Figure 4:
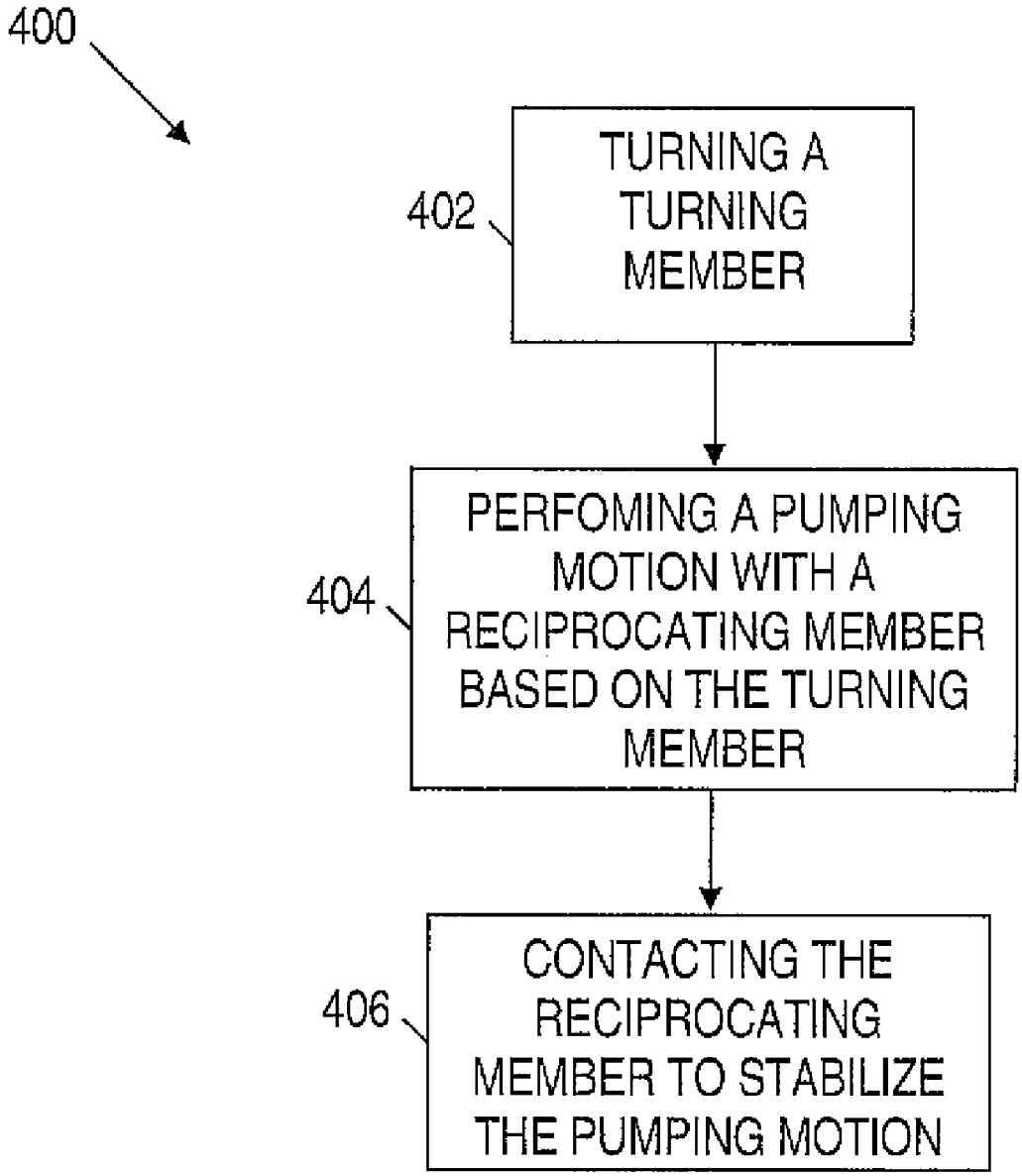
FIG. 4 shows a method in accordance with embodiments of the disclosure.

FIG. 4 shows a method 400 in accordance with embodiments of the disclosure. In FIG. 4, the method 400 comprises turning a turning member (e.g., a wheel) (block 402). In at least some embodiments, the turning member is turned by an electric motor. At block 404, a pumping motion is performed with a reciprocating member based on the turning member. For example, an eccentric bearing mounted to the turning member and placed into a recess of the reciprocating member may cause the pumping motion. At block 406, the reciprocating member is contacted to stabilize the pumping motion. In at least some embodiments, bearings are used to contact the reciprocating member. In various embodiments, the method 400 may comprise additional steps such as aligning a recess of the reciprocating member with an eccentric bearing attached to the turning member and/or attaching a plunger to the reciprocating member.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A pump, comprising:

a pump housing;

a turning member, turning about an axis of rotation;

a reciprocating member coupled to the turning member, the reciprocating member performing a pumping motion as the turning member turns; and at least one stabilization component separated from the turning member, wherein each at least one stabilization component is directly and rotatably mounted to the pump housing via an axle connector, wherein each at least one stabilization component is configured to contact the reciprocating member to stabilize the pumping motion and;

wherein the at least one stabilization component comprises a bearing that rotates around the axle connector in a perpendicular orientation with respect to the axis of rotation of the turning member.

2. The pump of claim 1, wherein the reciprocating member comprises a recess with an eccentric member attached to the turning member extending into the recess.

3. The pump of claim 2, further comprises a clearance between a non-rolling edge of the eccentric member and the reciprocating member.

4. The pump of claim 2, wherein the eccentric member comprises a bearing.

5. The pump of claim 4, wherein the bearing of the eccentric member is in a parallel orientation with respect to the axis of rotation of the turning member.

6. The pump of claim 1, wherein the at least one stabilization component is fixed between the turning member and the pump housing.

7. The pump of claim 6, further comprises clearances between the at least one stabilization component and the pump housing and between the at least one stabilization component and the turning member.

8. The pump of claim 1, wherein the at least one stabilization component comprises bearings on opposite sides of the turning member.

9. The pump of claim 1, further comprising a plunger coupled to the reciprocating member.

10. The pump of claim 9, wherein the reciprocating member comprises a plunger reception gap, wherein a pin inserted through the reciprocating member and the plunger reception gap attaches the plunger to the reciprocating member.

11. The pump of claim 1, further comprising an electrical motor configured to turn the turning member.

12. The pump of claim 11, wherein the electrical motor is powered by a rechargeable power supply in connection with a solar panel.

13. The pump of claim 1, wherein the pump comprises a chemical injection pump.

14. A method for operating a pump, comprising:

turning a wheel about an axis of rotation;

performing a pumping motion with a reciprocating member based on the wheel turning; and contacting the reciprocating member with at least one stabilization component separated from the wheel to stabilize the pumping motion, wherein each at least one stabilization component is directly and rotatably mounted to a pump housing via an axle connector, and wherein the at least one stabilization component comprises a bearing that rotates around the axle connector in a perpendicular orientation with respect to the axis of rotation of the wheel.

15. The method of claim 14, further comprising fixing the bearing in a space between the wheel and the pump housing.

16. The method of claim 14, further comprising aligning a recess of the reciprocating member with an eccentric bearing attached to the wheel.

17. The method of claim 14, further comprising attaching a plunger to the reciprocating member.

18. The method of claim 14, further comprising attaching the wheel to an electrical motor, the electrical motor being powered by a rechargeable battery in connection with a solar panel.

* * * * *